US008321988B1

(12) United States Patent
Randall

(10) Patent No.: US 8,321,988 B1
(45) Date of Patent: Dec. 4, 2012

(54) GROOVED BROOM FOR USE WITH A REFRIGERATED TRAILER FLOOR

(76) Inventor: Gregory Randall, Jacksonville, FL (US)

( * ) Notice: Subject to any disclaimer, the term of this patent is extended or adjusted under 35 U.S.C. 154(b) by 0 days.

(21) Appl. No.: 13/172,931

(22) Filed: Jun. 30, 2011

(51) Int. Cl.
*A46B 7/00* (2006.01)

(52) U.S. Cl. ..... 15/160; 15/172

(58) Field of Classification Search ..... 15/106, 15/159.1, 160, 172, 201; D4/132
See application file for complete search history.

(56) References Cited

U.S. PATENT DOCUMENTS 1,490,078 A * 4/1924 Neff ..... 15/194
1,555,630 A * 9/1925 Brock ..... 15/203
2,984,852 A * 5/1961 George ..... 15/144.4
3,218,662 A * 11/1965 Fielder, Jr. ..... 15/145
4,255,827 A * 3/1981 Palazzo ..... 15/160
4,286,349 A * 9/1981 Dugrenier ..... 15/111
5,412,829 A * 5/1995 Hefner ..... 15/52.1
D392,103 S * 3/1998 Zaccheria ..... D4/132
5,903,950 A * 5/1999 Lavin ..... 15/172
D414,343 S * 9/1999 Isaacson ..... D4/132
6,076,221 A * 6/2000 Bradshaw ..... 15/160
6,357,578 B1 * 3/2002 Shelby ..... 198/750.2
7,168,124 B2 * 1/2007 Dalias ..... 15/160

* cited by examiner

*Primary Examiner* — Randall Chin
(74) *Attorney, Agent, or Firm* — Kyle Fletcher

(57) ABSTRACT

The grooved broom for use with a refrigerated trailer floor that includes a plurality of separated regions of bristles having the same length. The separated regions of bristles form grooves, which are adaptively engaged upon a grooved or notch floor, which is typically associated with trailer floors. The grooved broom features adjustable ends that extends and retracts along each end of said broom, and which provides a means to sweep against sides of said floor. The adjustable end is adjusted via a spring-loaded button that is located on the broom, and which can lock upon one of a plurality of holes located on the respective adjustable end.

9 Claims, 4 Drawing Sheets

FIG. 4
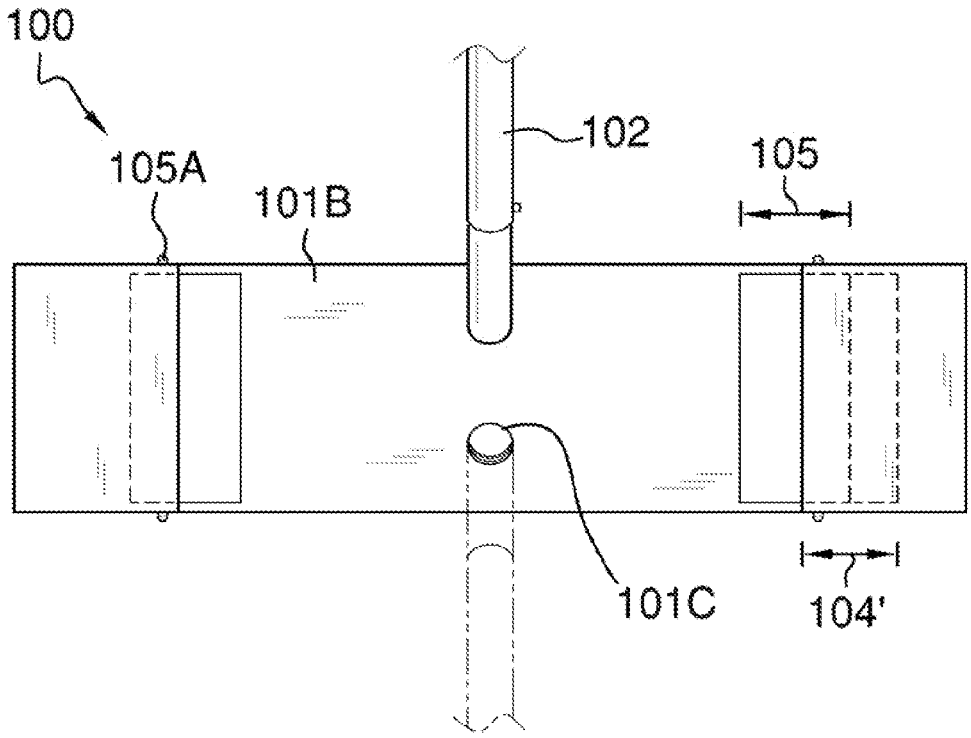
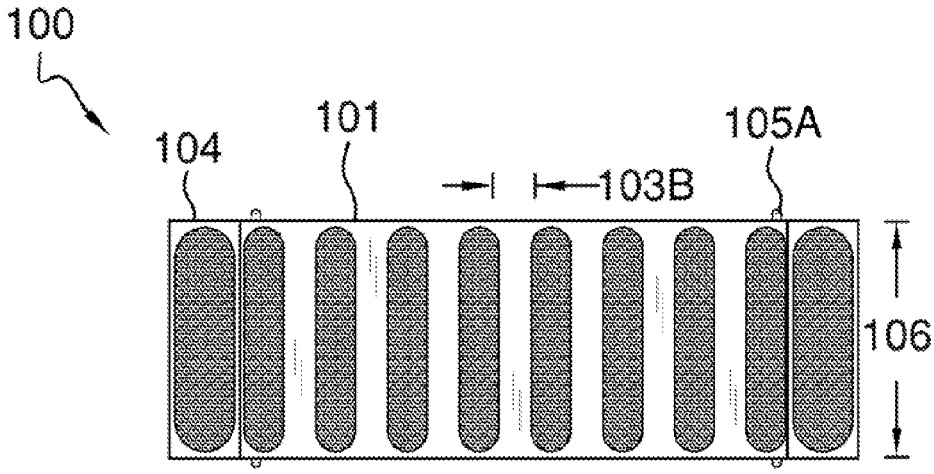
FIG. 5

GROOVED BROOM FOR USE WITH A REFRIGERATED TRAILER FLOOR

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of brooms, more specifically, a broom specifically adapted for use with a grooved floor of a refrigerated trailer.

B. Discussion of the Prior Art

As will be discussed immediately below, no prior art discloses a broom adapted for use with a grooved or notched floor of a trailer that is composed of a series of spaced regions of bristles having the same length; and wherein the broom features adjustable ends that slideably engage either end of the broom to provide adjustment for sweeping along sides of said trailer floor.

The Palazzo Patent (U.S. Pat. No. 4,255,827) discloses a 'reefer sweeper' broom device having bristles with alternating peaks and valleys. However, the broom fails to teach adjustable teaches bristles of alternating lengths as opposed to distinct segments of bristles that form a pattern suited for use with a grooved floor.

The Shelby Patent (U.S. Pat. No. 6,357,578) discloses a trailer floor cleaning device, which slides along the floor of the trailer. However, the device is not adapted to a broom specifically designed to sweep out grooves along a trailer floor.

The Neff et al. Patent (U.S. Pat. No. 1,490,078) discloses a broom which is constructed of multiple bristle segments. However, the broom does not teach spaced regions of bristles that form a pattern suited for use with a grooved floor. More particularly, the broom does not teach adjustable ends that can be adjusted to accommodate different sides of a trailer floor.

The Dalias Patent (U.S. Pat. No. 7,168,124) discloses a grill brush having bristle groups of differing lengths. However, the brush teaches different bristles lengths and not spaced regions of bristles of the same length that are ideally suited for sweeping a grooved or notched floor. Also, the brush does not have adjustable ends with respective regions of bristles for use in sweeping a grooved or notched side of a floor.

The Dugrenier Patent (U.S. Pat. No. 4,286,349) discloses a broiler grill cleaning brush having bristles of differing lengths. However, the brush employs bristles of varying lengths and not separate regions of bristles having the same length along with adjustable ends for engaging sides of a grooved or notched floor.

The Zaccheria Patent (U.S. Pat. No. Des. 392,103) illustrates an ornamental design for a reefer trailer broom, which does not teach a broom having separated regions of bristles having the same length along with adjustable ends.

The Isaacson Patent (U.S. Pat. No. Des. 414,343) illustrates an ornamental design for a trailer broom, which does not teach a broom having separated regions of bristles having the same length along with adjustable ends.

The Reefer Sweeper Trailer Broom, a non-patent piece of prior art, located on www.dieselboss.com, depicts a broom having segments of bristles of varying heights. However, the broom does not use separate regions of bristles of the same length, and having adjustable ends that can be used to sweep along sides of a grooved or notched trailer floor.

While the above-described devices fulfill their respective and particular objects and requirements, they do not describe a broom adapted for use with a grooved or notched floor of a trailer that is composed of a series of spaced regions of bristles having the same length; and wherein the broom features adjustable ends that slideably engage either end of the broom to provide adjustment for sweeping along sides of said trailer floor. In this regard, the grooved broom departs from the conventional concepts and designs of the prior art.

SUMMARY OF THE INVENTION

The grooved broom for use with a refrigerated trailer floor that includes a plurality of separated regions of bristles having the same length. The separated regions of bristles form grooves, which are adaptively engaged upon a grooved or notch floor, which is typically associated with trailer floors. The grooved broom features adjustable ends that extends and retracts along each end of said broom, and which provides a means to sweep against sides of said floor. The adjustable end is adjusted via a spring-loaded button that is located on the broom, and which can lock upon one of a plurality of holes located on the respective adjustable end.

An object of the invention is to provide a grooved broom that is adapted for use in sweeping the floor of a grooved or notched trailer.

A further object of the invention is to provide a bristled broom having separated regions of bristles of the same length as opposed to traditional reefer brooms, which employ bristle regions of different lengths.

A further object of the invention is to provide adjustable ends that extend and retract along each end of the broom, which engages different sides of the trailer floor.

These together with additional objects, features and advantages of the grooved broom for use with a refrigerated trailer floor will be readily apparent to those of ordinary skill in the art upon reading the following detailed description of presently preferred, but nonetheless illustrative, embodiments of the grooved broom for use with a refrigerated trailer floor when taken in conjunction with the accompanying drawings.

In this respect, before explaining the current embodiments of the grooved broom for use with a refrigerated trailer floor in detail, it is to be understood that the grooved broom for use with a refrigerated trailer floor is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the grooved broom for use with a refrigerated trailer floor.

It is therefore important that the claims be regarded as including such equivalent construction insofar as they do not depart from the spirit and scope of the grooved broom for use with a refrigerated trailer floor. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention:

In the drawings:

FIG. 4 illustrates a top view of the grooved broom with broken lines indicating the supports located along the top surface of the broom, and which house the spring-loaded button;

FIG. 5 illustrates a bottom view of the grooved broom indicating the separate regions of bristles located along the bottom of the brush along with the separate regions of bristles located on the adjustable ends.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
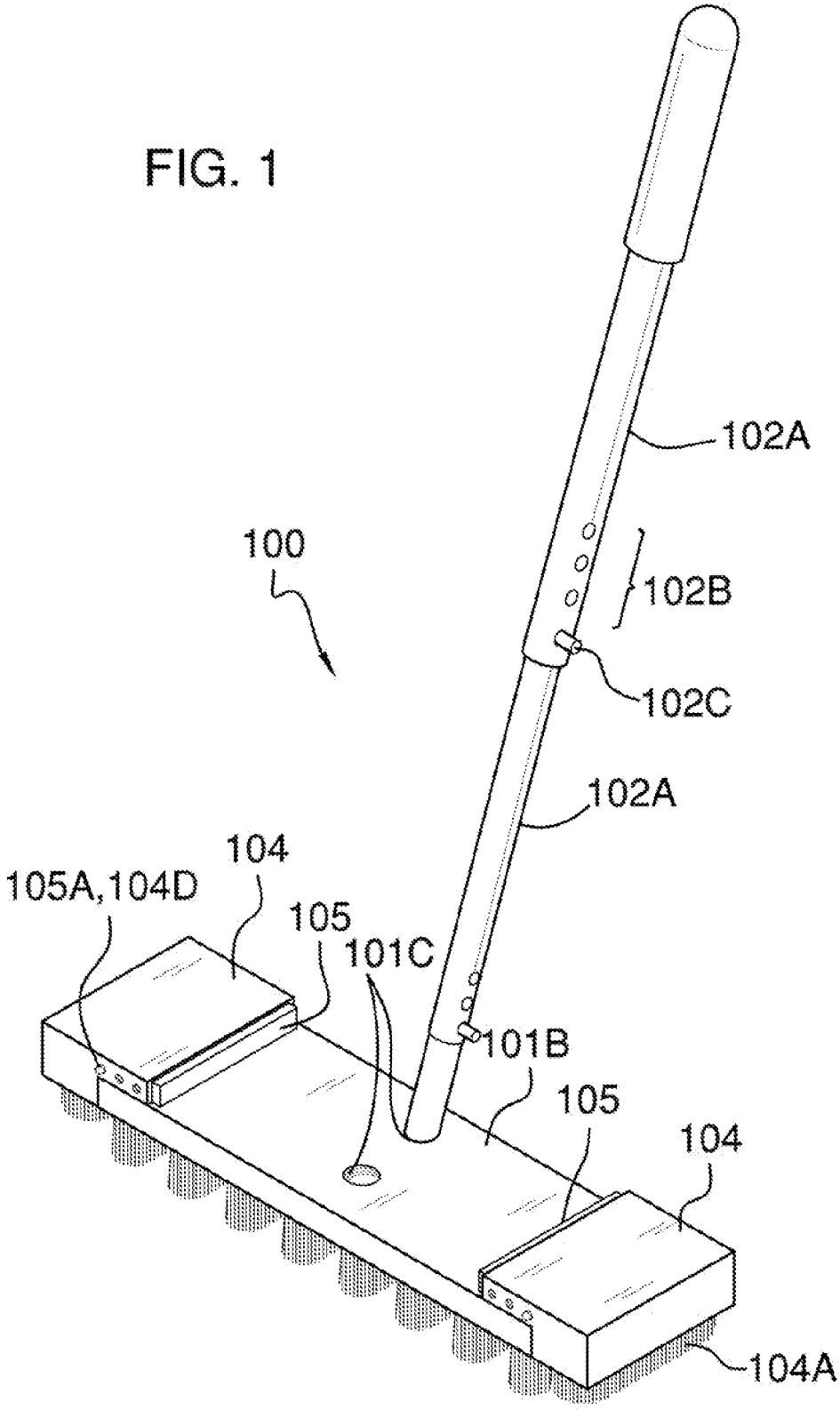
FIG. 1 illustrates a perspective view of the grooved broom by itself and with the adjustable ends fully retracted.
Figure 2:
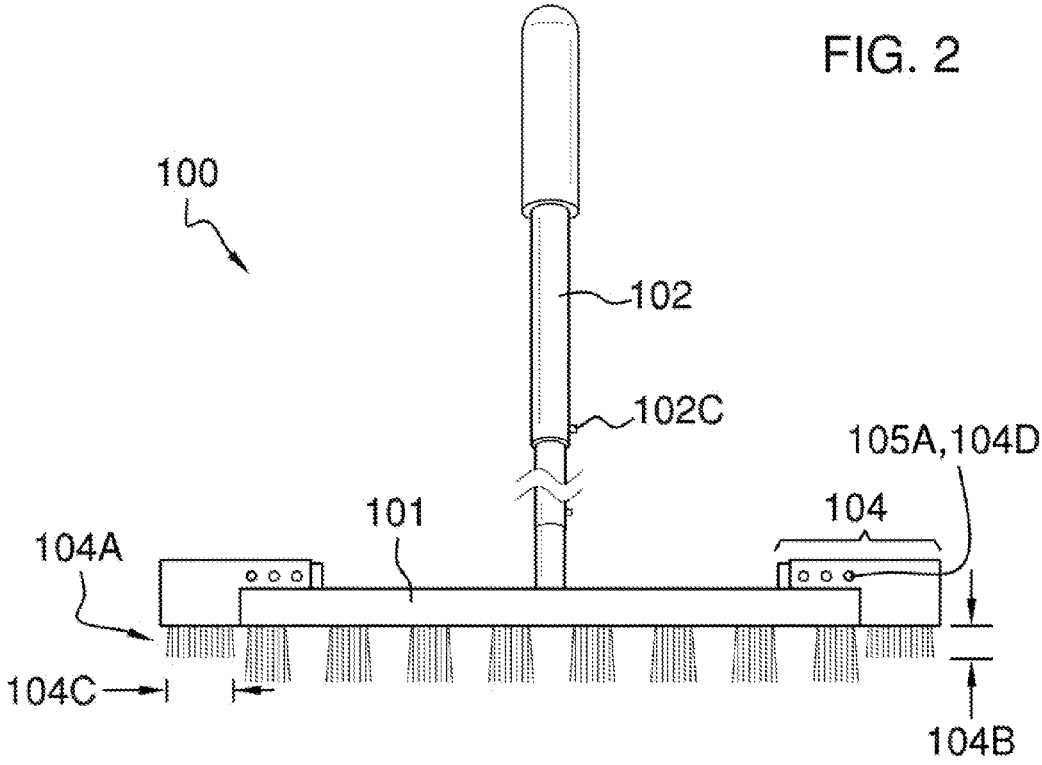
FIG. 2 illustrates a front view of the grooved broom in which the adjustable ends are fully retracted.
Figure 3:
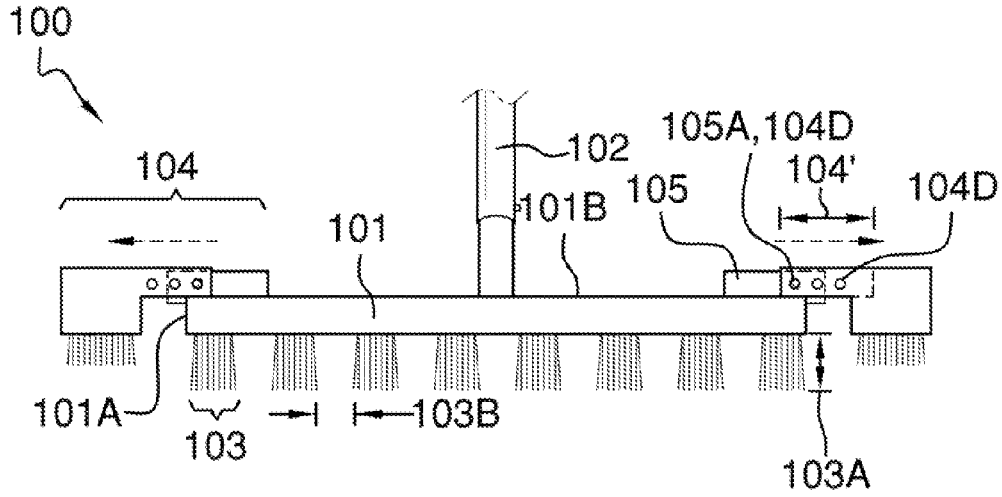
FIG. 3 illustrates a front view of the grooved broom in which the adjustable ends are extending as depicted by arrows extending away from each end of the broom, and detailing different spring-loaded button position.
Figure 6:
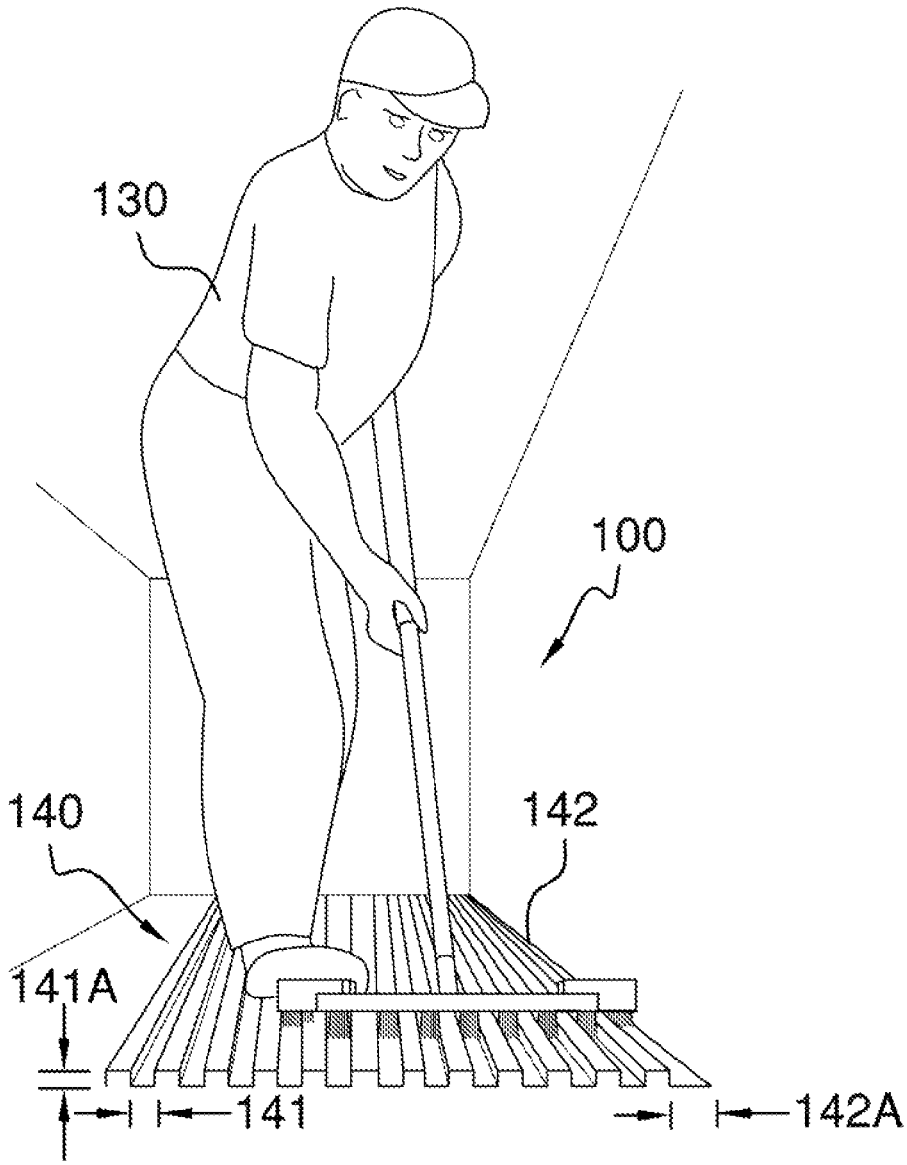
FIG. 6 illustrates a perspective view of the grooved broom in use on a trailer floor having grooves located thereon and in which one of the adjustable ends is adapted for use with a side of said trailer floor.

Detailed reference will now be made to the preferred embodiment of the present invention, examples of which are illustrated in FIGS. 1-6. A grooved broom for use with a refrigerated trailer floor 100 (hereinafter invention) includes a frame 101 from which a handle 102 of an undefined length extends upwards for use by an end user 130.

The frame 101 includes ends 101A, and is made of a material comprising a plastic, metal, wood, or carbon fiber composite. The frame 101 includes a plurality of distinct regions of bristles 103. Each region of bristle 103 is of uniform shape and length 103A and are separated by a distance 103B so as to form a pattern that is suitable for use with a trailer floor 140. It shall be noted that the trailer floor 140 includes notches 141 across a width of the trailer floor 140. More importantly, the trailer floor 140 includes, sides 142 that are often indifferent with the notches 141 such that there is a gap 142A that is not uniform with respect to the notches 141.

The length 103A of the bristles 103 are adapted to engage a notch height 141A of the notch 141 of the trailer floor 140. The distance 103B between each region of bristles 103 is specific to each notch 141.

The invention 100 includes adjustable ends 104 that are positioned on each end 101A of the frame 101. The adjustable ends 104 include a region of end bristles 104A of a distinct height 104B and a distinct width 104C. The region of end bristles 104A extends downwardly from the adjustable ends 104. The adjustable ends 104 have an "L" shaped body that attaches on a top surface 101B of the frame 101.

The frame 101 features a support 105 on the top surface 101B of each end 101A of the frame 101. The support 105 includes a spring-loaded pin 105A. The adjustable ends 104 have a cavity 104' that enables the adjustable end 104 to slide onto the support 105. The cavity 104' is located on the portion of the adjustable end 104 closest the handle 102. The adjustable ends 104 each feature a plurality of holes 104D that are equally spaced and enable the adjustable end 104 to lock into varying positions with respect to the frame 101. The adjustable ends 104 are adjusted to engage the end bristles 104A against the gap 142A formed along each side 142 of the trailer 140, which enables the invention 100 to be modified for use with different trailers.

The handle 102 is composed of a plurality of sections 102A that connect to one another via a plurality of holes 102B and a spring-loaded pin 102C, which work to adjust the overall length of the handle 102.

The frame 101 includes handle holes 101C that each includes internal threading such that a bottom of the handle 102 can screw into the frame 101. The handle holes 101C are oriented at an angle with respect to one another such that the handle 102 can attach to the frame 101 at different angles thereon.

Referring to FIG. 5, the bristles 103 and the end bristles 104A each have a depth 106, which is less than the width of the frame 101 or the width of the adjustable ends 104.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The invention claimed is:

1. A grooved broom for use with a refrigerated trailer floor comprising:

a handle extending from a frame from which includes a plurality of distinct regions of bristles extend downwardly therefrom;

wherein all regions of bristles are of uniform length and are separated by a distance in order to form a pattern consistent with a notched floor of a trailer;

wherein each end of the broom includes adjustable ends having a region of end bristles that can engage sides of said trailer floor that may be inconsistent with the pattern of grooves of the trailer floor;

wherein the adjustable ends have an "L" shaped body that attaches on a top surface of the frame;

wherein the frame includes a support located on the top surface of each end of the frame; wherein each support includes a spring-loaded pin that engages one of a plurality of holes located on the adjustable end;

wherein the adjustable ends each have a cavity that enables the adjustable end to slide onto the support; wherein the cavity is located on the portion of the adjustable end closest the handle;

wherein the plurality of holes located on each adjustable end are equally spaced and enable the adjustable end to lock into varying positions with respect to the frame.

2. The grooved brom for use with a refrigerated trailer floor as described in claim 1 wherein the length of the bristles engage a notch height of the notch of the trailer floor.

3. The grooved broom for use with a refrigerated trailer floor as described in claim 1 wherein the bristles and the end bristles each have a depth, which is less than the width of the frame or the width of the adjustable ends.

4. The grooved broom for use with a refrigerated trailer floor as described in claim 1 wherein the frame includes a plurality of handle holes that enable the handle to attach thereon.

5. The grooved broom for use with a refrigerated trailer floor as described in claim 1 wherein the handle is composed of a plurality of sections that connect to one another via a plurality of holes ad a spring-loaded pin, which work to adjust the overall length of the handle.

6. A grooved broom for use with a refrigerated trailer floor comprising:

a handle extending from a frame from which includes a plurality of distinct regions of bristles extend downwardly therefrom;

wherein all regions of bristles are of uniform length and are separated by a distance in order to form a pattern consistent with a notched floor of a trailer;

wherein each end of the broom includes adjustable ends having a region of end bristles that can engage sides of said trailer floor that may be inconsistent with the pattern of grooves of the trailer floor;

wherein the length of the bristles engage a notch height of the notch of the trailer floor;

wherein the bristles and the end bristles each have a depth, which is less than the width of the frame or the width of the adjustable ends;

wherein the frame includes a support located on the top surface of each end of the frame; wherein each support includes a spring-loaded pin that engages one of a plurality of holes located on the adjustable end;

wherein the adjustable ends each have a cavity that enables the adjustable end to slide onto the support; wherein the cavity is located on the portion of the adjustable end closest the handle;

wherein the plurality of holes located on each adjustable end are equally spaced and enable the adjustable end to lock into varying positions with respect to the frame.

7. The grooved broom for use with a refrigerated trailer floor as described in claim 6, wherein the adjustable ends have an "L" shaped body that attaches on a top surface of the frame.

8. The grooved broom for use with a refrigerated trailer floor as described in claim 6 wherein the frame includes a plurality of handle holes that enable the handle to attach thereon.

9. The grooved broom for use with a refrigerated trailer floor as described in claim 6 wherein the handle is composed of a plurality of sections that connect to one another via a plurality of holes and a spring-loaded pin, which work to adjust the overall length of the handle.

* * * * *